US006582140B2

(12) United States Patent
Kimura et al.

(10) Patent No.: US 6,582,140 B2
(45) Date of Patent: Jun. 24, 2003

(54) RECORDING MEDIA DISCHARGING DEVICE AND INK-JET PRINTER WITH THE DISCHARGING DEVICE

(75) Inventors: Masaharu Kimura, Daito (JP); Shunichi Hayashiyama, Nara (JP); Tatsuya Ogawa, Nara (JP); Shigeru Yoshida, Nara (JP); Yasunobu Ohkawa, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/826,095

(22) Filed: Apr. 4, 2001

(65) Prior Publication Data

US 2001/0033764 A1 Oct. 25, 2001

(30) Foreign Application Priority Data

Apr. 25, 2000 (JP) ..... 2000-124579

(51) Int. Cl.[7] ..... B41J 13/03; B41J 13/10
(52) U.S. Cl. ..... 400/636; 400/642; 400/645
(58) Field of Search ..... 400/636, 634, 400/637, 637.3, 638, 642, 645; 347/104

(56) References Cited

U.S. PATENT DOCUMENTS

| | | | | | |
|---|---|---|---|---|---|
| 5,420,621 | A | * | 5/1995 | Richtsmeier et al. | 271/10.04 |
| 5,534,902 | A | * | 7/1996 | Hoesly | 271/240 |
| 5,615,873 | A | | 4/1997 | Kobayashi et al. | 271/121 |
| 6,074,055 | A | * | 6/2000 | Myung | 347/104 |
| 6,416,176 | B1 | * | 7/2002 | Yasui et al. | 347/104 |

FOREIGN PATENT DOCUMENTS

| | | |
|---|---|---|
| JP | 6 115195 | 4/1994 |

* cited by examiner

*Primary Examiner*—Daniel J. Colilla
(74) *Attorney, Agent, or Firm*—Renner, Otto, Boisselle & Sklar

(57) ABSTRACT

A media discharging device for an ink-jet printer includes a rubber roller and star roller. A pair of paper guides are arranged on both sides, with respect to its rotary shaft of, the star roller, opposing each other and close to the star roller. Each paper guide has a slant which is inclined gradually upward in the paper discharge direction. This slant is positioned offset with respect to the path of movement of the projections on the star roller towards the paper discharge side, so as to prevent the rear edge of the recording paper from dropping into the recessed portions of the star roller.

14 Claims, 10 Drawing Sheets

RECORDING MEDIA DISCHARGING DEVICE AND INK-JET PRINTER WITH THE DISCHARGING DEVICE

BACKGROUND OF THE INVENTION (1) Field of the Invention

The present invention relates to a recording media discharging device for use in a paper discharging portion of an ink-jet printer, for example, as well as relating to an ink-jet printer with the discharging device. In particular, the present invention is directed to preventing damage to recording media in a discharging device using a star roller for ejecting recording media.

(2) Description of the Prior Art

Generally, in an ink-jet type image forming apparatus (referred to hereinbelow as an ink-jet printer), ink drops are ejected sequentially on the upper surface of recording paper being continuously fed to perform image forming. The recording paper with images formed thereon is discharged and stacked one after another onto the paper output tray by a discharging device.

For example, Japanese Patent Application Laid-Open Hei 6 No. 115195 discloses a discharging device which is comprised of a rubber roller in contact with the undersurface of a recording paper and a star roller in contact with the upper surface (image forming face) of the recording paper. The recording paper is held between and conveyed by these two rollers, whereby the recording paper is discharged to the paper output tray. This rubber roller is a drive roller which is turned by a drive force transmitted from a motor. The star roller is an follower roller, which is turned along with the conveyance of the recording paper. This star roller is formed with discrete projections radially arranged on the peripheral surface thereof parallel to its axis. Formed on the peripheral surface between these projections are recessed portions, which are recesses between the projections. Therefore, only the projections come in contact with the upper surface of the recording paper so as to reduce the contact area of the roller with the upper surface of the recording paper, whereby ink smudges on the recording paper will not occur.

However, when such a star roller is used, there occurs the problem as follows. That is, when the leading part of a recording paper 'a' (the portion on the downstream side with respect to the paper feed direction) is held and conveyed by the discharging device as shown in FIG. 1A, and when the center portion of recording paper 'a' is held and conveyed by the discharging device as shown in FIG. 1B, a high enough conveying force is given to recording paper 'a'. When, however, the rear end part of recording paper 'a' (the portion on the upstream side with respect to the sheet feed direction) is held and conveyed as shown in FIG. 1C, the leading edge of recording paper 'a' comes into contact with a paper output tray 'b', so that the frictional force between this recording paper 'a' and output tray 'b' acts as a resistance against conveyance, so that a sufficient enough conveying force cannot be given to recording paper 'a'. When the holding of recording paper 'a' between rubber roller 'c' and star roller 'd' is released from this state, as shown in FIG. 1D, the rear edge of recording paper 'a' may abide near the contact point between rubber roller 'c' and star roller 'd' due to insufficiency of the conveying force. Once this situation occurs, there is a risk of the rear edge of recording paper 'a' (the upstream edge with respect to the feed direction) dropping into the recessed portion 'e' on the peripheral side of the star roller, as shown in FIG. 2A. In detail, since paper output tray 'b' is generally located below the exit port of recording paper 'a' in order to allow for beneficial sheet discharge operation. Therefore, in the state that the front end part of recording paper 'a' is put in contact with paper output tray 'b' as shown in FIG. 1D, the rear part of recording paper 'a' springs upwards, which further promotes the fitting of the rear edge into the recessed portion 'e'.

Star roller 'd' further rotates from this condition where the rear edge of recording paper 'a' has dropped into recessed portion 'e', the rear edge of recording paper 'a' may get nipped between the edge, designated at 'f' of the exit port (one of the printer casing members) and the projection 'g' on the star roller peripheral side as shown in FIG. 2B and recording paper 'a' may be damaged. In general, star roller 'd' is composed of a multiple number of roller elements arranged along the direction perpendicular to the feed direction of recording paper 'a' (perpendicular to the document surface of FIGS. 2A and 2B), so recording paper 'a' is damaged at multiple sites along its rear edge, thus making it impossible to provide a beneficial printout. In this way, the discharging device of the conventional ink-jet printers has not yet provided sufficiently reliable paper discharge performance.

SUMMARY OF THE INVENTION

The present invention has been devised in view of what has been discussed above, it is therefore an object of the present invention to provide a discharging device using a star roller, which can realize a beneficial discharge operation by avoiding recording paper being damaged by the rear edge of recording paper dropping into the recessed portions on the peripheral side of the star roller.

In order to achieve the above object, the present invention prevents the rear edge from dropping into recessed portions of the star roller by guiding the rear edge of the recording medium in the discharge direction when the recording medium passes the star roller.

Specifically, the present invention is featured as follows:

In accordance with the first aspect of the present invention, a recording media discharging device using a star roller for conveying recording media with images formed thereon in the discharge direction, includes: guide means for guiding the upstream edge of a recording medium with respect to the feed direction so that the edge will not drop into the recessed portions on the peripheral side of the star roller when the edge passes the star roller.

In accordance with the second aspect of the present invention, the recording media discharging device having the above first feature is characterized in that the star roller is comprised of multiple elements arranged at separate positions on the rotary shaft that is extended perpendicularly to the feed direction of recording media, and as the guide means a pair of guide elements are arranged close to each star roller element and on both sides thereof with respect to the extended direction of the rotary shaft.

In accordance with the third aspect of the present invention, the recording media discharging device having the above first feature is characterized in that the guide means has a guide surface for guiding the upstream edge of a recording medium with respect to the feed direction, and this guide surface is provided with a slant which is inclined gradually up in the paper discharge direction, thereby prevents the edge of the recording medium from dropping into the recessed portions of the star roller while permitting the edge of the recording medium to jump upwards.

In accordance with the fourth aspect of the present invention, the recording media discharging device having the above second feature is characterized in that the guide means has a guide surface for guiding the upstream edge of a recording medium with respect to the feed direction, and this guide surface is provided with a slant which is inclined gradually up in the paper discharge direction, thereby prevents the edge of the recording medium from dropping into the recessed portions of the star roller while permitting the edge of the recording medium to jump upwards.

In accordance with the fifth aspect of the present invention, the recording media discharging device having the above first feature further includes: a conveying roller for holding and conveying recording media between itself and the star roller and is characterized in that the level distance between the outer peripheral surface of the conveying roller and the bottom of the guide means is set to be equal to or shorter than the interval between adjacent projections formed on the peripheral surface of the star roller element.

In accordance with the sixth aspect of the present invention, the recording media discharging device having the above second feature further includes: a conveying roller for holding and conveying recording media between itself and the star roller and is characterized in that the level distance between the outer peripheral surface of the conveying roller and the bottom of the guide means is set to be equal to or shorter than the interval between adjacent projections formed on the peripheral surface of the star roller element.

In accordance with the seventh aspect of the present invention, the recording media discharging device having the above third feature further includes: a conveying roller for holding and conveying recording media between itself and the star roller and is characterized in that the level distance between the outer peripheral surface of the conveying roller and the bottom of the guide means is set to be equal to or shorter than the interval between adjacent projections formed on the peripheral surface of the star roller element.

In accordance with the eighth aspect of the present invention, the recording media discharging device having the above fourth feature further includes: a conveying roller for holding and conveying recording media between itself and the star roller and is characterized in that the level distance between the outer peripheral surface of the conveying roller and the bottom of the guide means is set to be equal to or shorter than the interval between adjacent projections formed on the peripheral surface of the star roller element.

In accordance with the ninth aspect of the present invention, an ink-jet printer includes: a recording media discharging device including: a star roller for conveying recording media with images formed thereon in the discharge direction; and guide means for guiding the upstream edge of a recording medium with respect to the feed direction so that the edge will not drop into the recessed portions on the peripheral side of the star roller when the edge passes the star roller, wherein an image is formed on the upper surface of the recording medium by ejecting ink droplets from an image forming means, and the recording medium with an image formed thereon is discharged toward an output portion by the recording media discharging device.

In accordance with the tenth aspect of the present invention, the ink-jet printer having the above ninth feature is characterized in that the star roller is comprised of multiple elements arranged at separate positions on the rotary shaft that is extended perpendicularly to the feed direction of recording media, and as the guide means a pair of guide elements are arranged close to each star roller element and on both sides thereof with respect to the extended direction of the rotary shaft.

In accordance with the eleventh aspect of the present invention, the ink-jet printer having the above ninth feature is characterized in that the guide means has a guide surface for guiding the upstream edge of a recording medium with respect to the feed direction, and this guide surface is provided with a slant which is inclined gradually up in the paper discharge direction, thereby prevents the edge of the recording medium from dropping into the recessed portions of the star roller while permitting the edge of the recording medium to jump upwards.

In accordance with the twelfth aspect of the present invention, the ink-jet printer having the above tenth feature is characterized in that the guide means has a guide surface for guiding the upstream edge of a recording medium with respect to the feed direction, and this guide surface is provided with a slant which is inclined gradually up in the paper discharge direction, by permitting the edge of the recording medium to jump upwards, thereby prevents the edge of the recording medium from dropping into the recessed portions of the star roller while permitting the edge of the recording medium to jump upwards.

In accordance with the thirteenth aspect of the present invention, the ink-jet printer having the above ninth feature is characterized in that the recording media discharging device further includes: a conveying roller for holding and conveying recording media between itself and the star roller and the level distance between the outer peripheral surface of the conveying roller and the bottom of the guide means is set to be equal to or shorter than the interval between adjacent projections formed on the peripheral surface of the star roller element.

In accordance with the fourteenth aspect of the present invention, the ink-jet printer having the above tenth feature is characterized in that the recording media discharging device further includes: a conveying roller for holding and conveying recording media between itself and the star roller and the level distance between the outer peripheral surface of the conveying roller and the bottom of the guide means is set to be equal to or shorter than the interval between adjacent projections formed on the peripheral surface of the star roller element.

In accordance with the fifteenth aspect of the present invention, the ink-jet printer having the above eleventh feature is characterized in that the recording media discharging device further includes: a conveying roller for holding and conveying recording media between itself and the star roller and the level distance between the outer peripheral surface of the conveying roller and the bottom of the guide means is set to be equal to or shorter than the interval between adjacent projections formed on the peripheral surface of the star roller element.

In accordance with the sixteenth aspect of the present invention, the ink-jet printer having the above twelfth feature is characterized in that the recording media discharging device further includes: a conveying roller for holding and conveying recording media between itself and the star roller and the level distance between the outer peripheral surface of the conveying roller and the bottom of the guide means is set to be equal to or shorter than the interval between adjacent projections formed on the peripheral surface of the star roller element.

According to the present invention, when the recording medium after image formation is discharged by the star roller in the recording media discharging device, the upstream edge of the recording medium with respect to the feed direction comes in contact with the guide means and is guided thereby when the edge passes the star roller. Therefore, it is possible to prevent the edge part of the recording medium from dropping into the recessed portions on the peripheral surface of the star roller. As a result, it is possible to prevent the edge from being damaged by the projections on the peripheral side of the star roller.

According to the present invention, it is possible to positively prevent the upstream edge, with respect to the feed direction, of the recording medium, from dropping into the recessed portions on the peripheral side of the star roller. For example, as shown in FIG. 10A, when guide element 9 is provided only on one side of star roller element 8, there is a possibility that the side edge on the upstream edge of recording paper P with respect to its feed direction might fail to be guided by paper guide 9 in some cases, depending upon the size or the feed position of recording paper P being conveyed (shown in an imaginary line in the figure). In the present invention, since a pair of guide means 9 and 9 are arranged adjacent to and on both sides of each star roller element 8, it is possible for the guide means 9 to guide the part at the side edge of the upstream edge of recording paper P with respect to its feed direction as shown in FIG. 10B, thus never causing any damage to the recording media.

According to the present invention, it is possible to specifically limit the shape of the guide means for preventing the edge of the recording medium from dropping into the recessed portions of the star roller. Particularly, since the guide surface permits the rear edge of the recording medium to jump up, it is possible to make smooth the discharge movement of the recording medium when the output portion (paper output tray in the case of printer) of recording media is located below the position of the exit port of the recording media. In other words, when the output portion of recording media is located below, the recording media are discharged with their leading edge inclined downward in the discharge direction. The configuration of the present invention permits the upstream edge with respect to the feed direction of recording media to jump up, thus assuring the aforementioned discharging posture, and hence realizing a smooth discharge operation.

According to the present invention, it is possible to avoid such a situation that the edges of the recording media are damaged by the projections on the peripheral side of the star roller, so that a reliable ink-jet printer which can provide beneficial printouts can be obtained.

DESCRIPTION OF THE PREFERRED EMBODIMENTS

The embodiment of the present invention will hereinafter be described with reference to the accompanying drawings. The description of this embodiment will be made taking an example where the discharging device of the present invention is applied to the paper discharging portion of a color ink-jet printer.

Explanation of a Color Ink-jet Printer Configuration

Figure 1A:
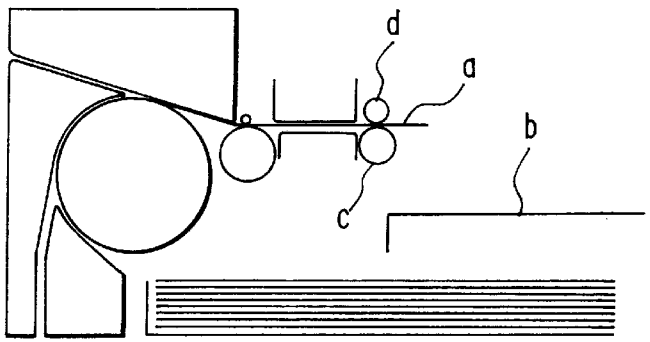
FIG. 1A PRIOR ART
FIGS. 1A to 1D are diagrams for illustrating the discharge operation of recording paper in a conventional example.
Figure 1B:
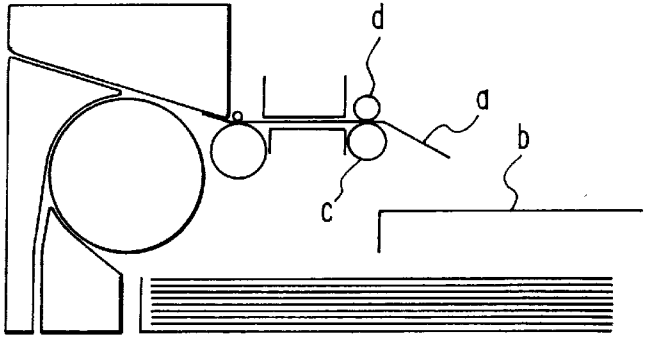
FIG. 1B PRIOR ART
Figure 1C:
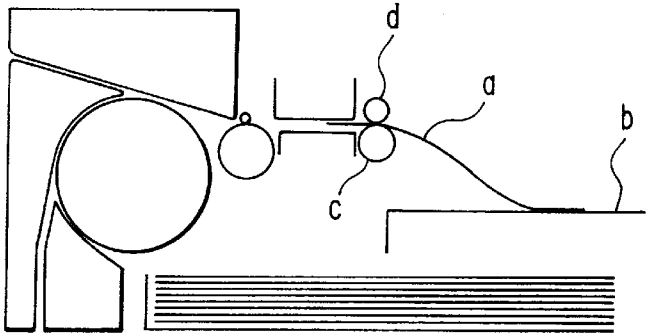
FIG. 1C PRIOR ART
Figure 1D:
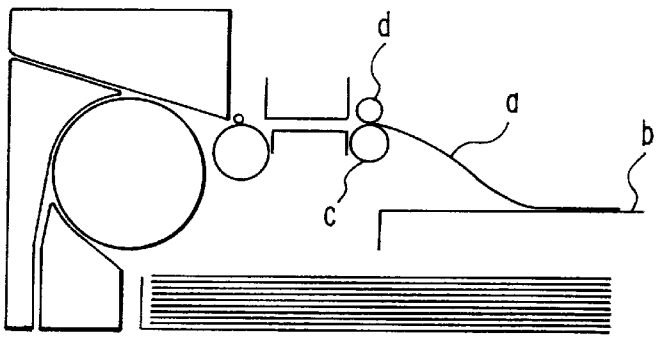
FIG. 1D PRIOR ART
Figure 2A:
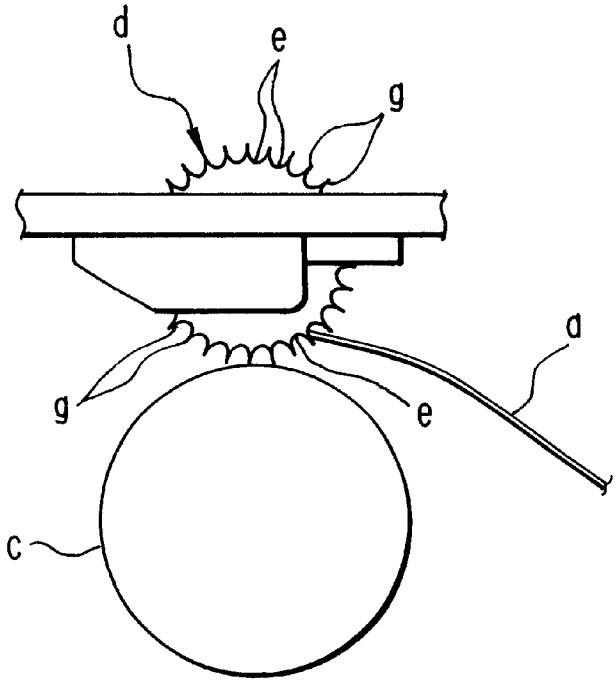
FIG. 2A PRIOR ART
FIGS. 2A and 2B are diagrams for illustrating the movement of recording paper when it gets damaged in a conventional example.
Figure 2B:
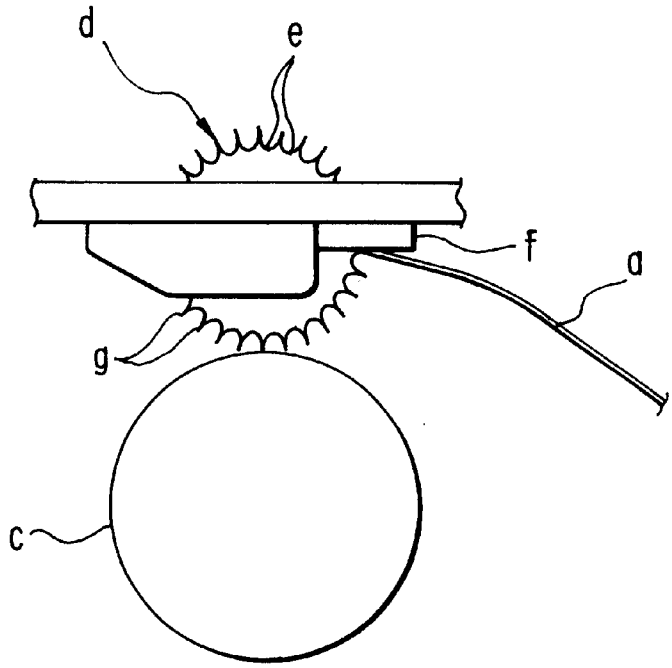
FIG. 2B PRIOR ART
Figure 3:
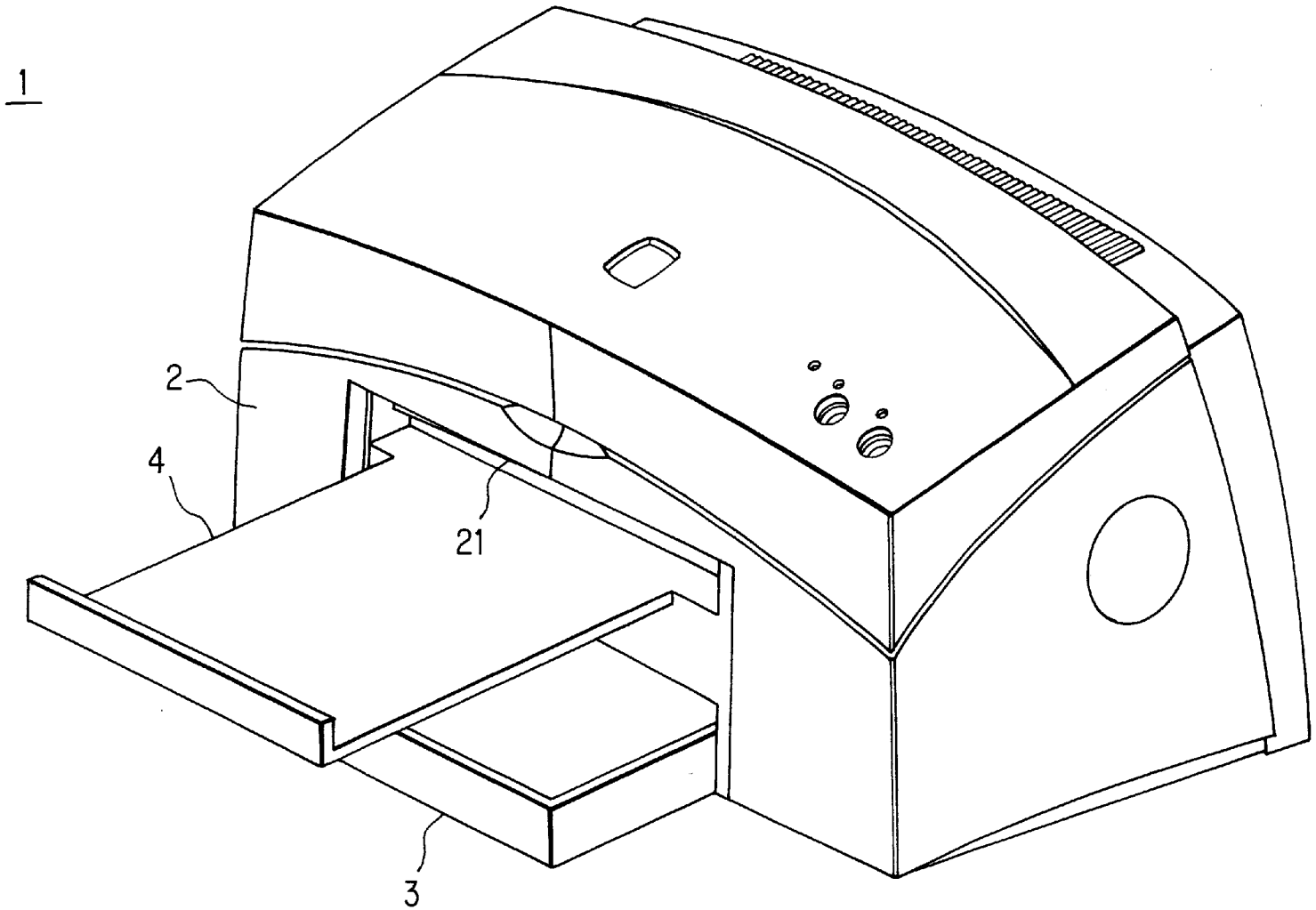
FIG. 3 is a perspective view showing the appearance of a color ink-jet printer according to an embodiment of the present invention.
Figure 4:
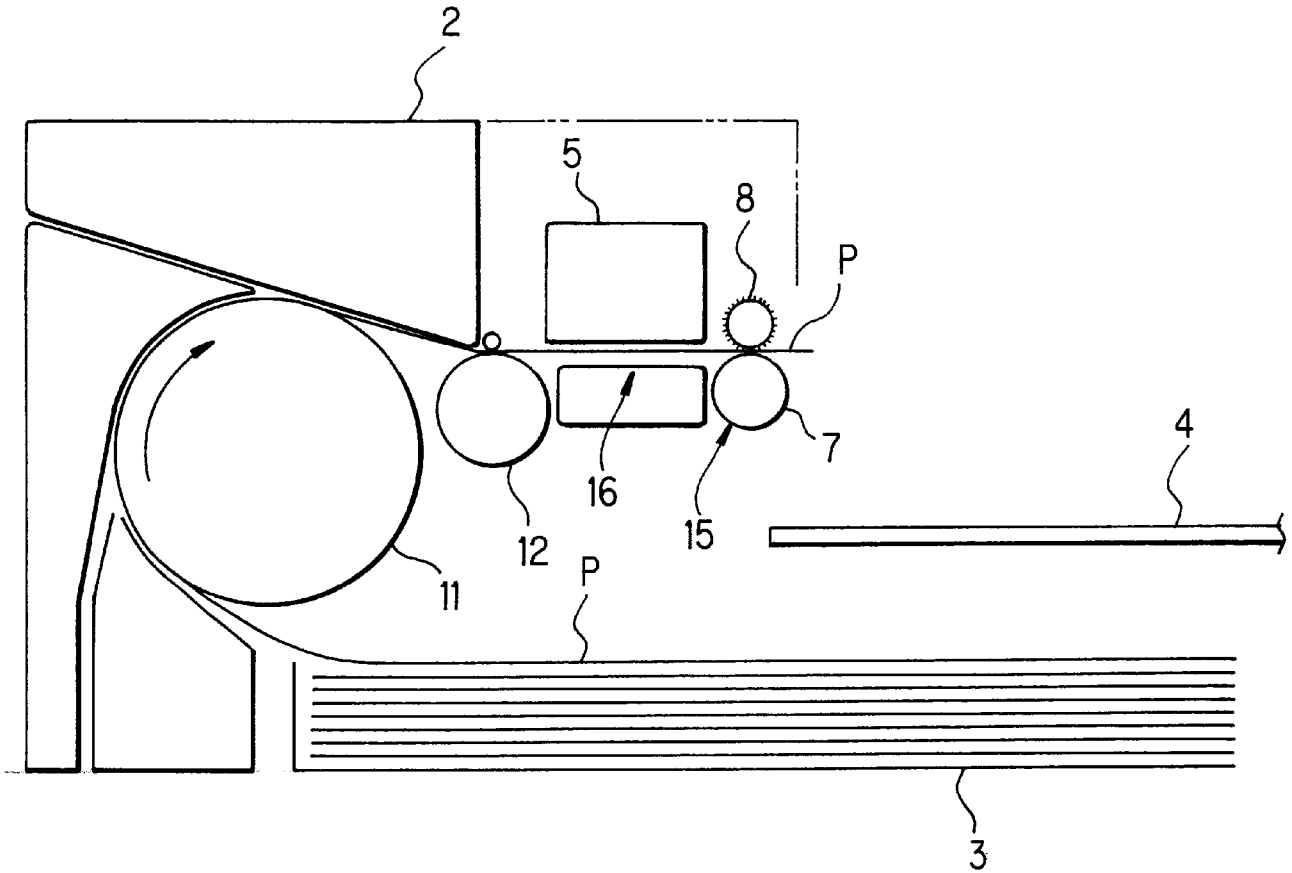
FIG. 4 is a schematic view showing an internal structure of a color ink-jet printer.

A begin with, the configuration of a color ink-jet printer 1 according to this embodiment will be described with reference to FIGS. 3 and 4. FIG. 3 is a perspective view showing the appearance of a color ink-jet printer 1. FIG. 4 is a schematic view showing the internal structure of color ink-jet printer 1.

This color ink-jet printer 1 has a paper feed cassette 3 on the front side (on the right side in FIG. 4) of a cabinet 2 and a paper output tray 4 over paper feed cassette 3 on the front side.

As shown in FIG. 4, inside cabinet 2 a pickup roller(not shown), a feed roller 11, a pair of conveying rollers 12, a PS roller(not shown), an ink-jet mechanism 5 as the image forming means and a paper discharging device 15 are arranged from paper feed cassette 3 to paper output tray 4 in the order mentioned.

Figure 5:
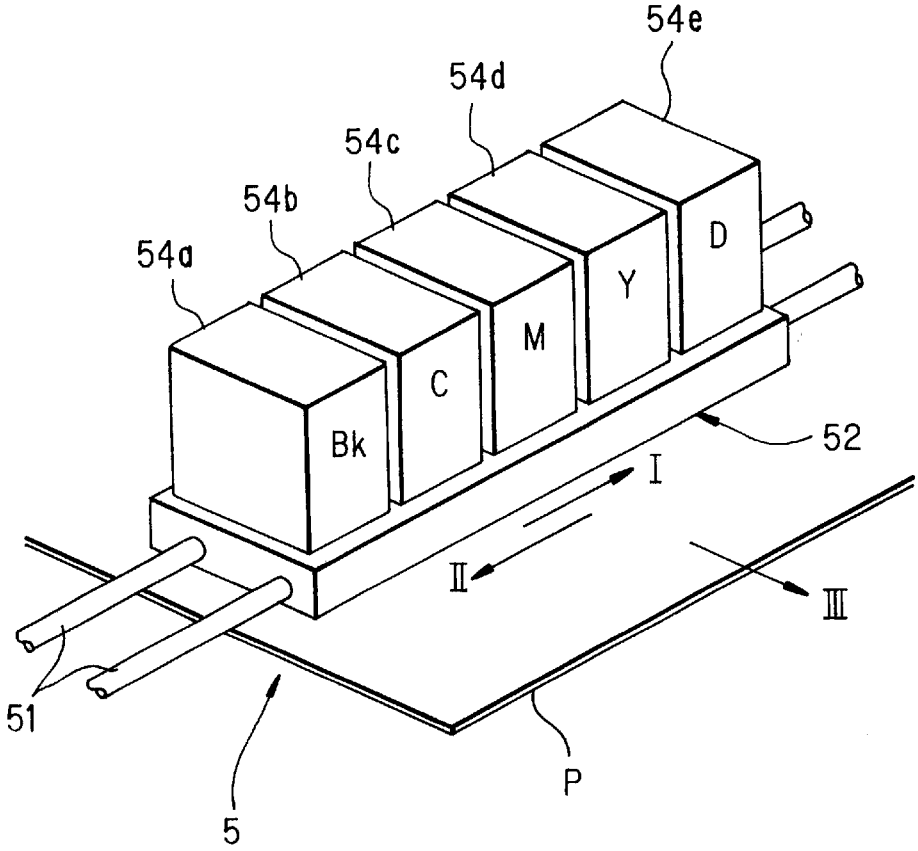
FIG. 5 is a perspective view showing an ink carriage and its peripheral parts.

The above ink-jet mechanism 5 includes a pair of ink-jet head carriage support shafts 51 and 51 (see FIG. 5) laid in the direction perpendicular to the document surface of FIG. 4, an ink head carriage 52 supported on these ink head carriage support shafts 51 and 51 and an ink head 53 (see FIG. 6) to be reciprocated together with ink head carriage 52 along ink head carriage support shafts 51 and 51. Mounted on ink head carriage 52 are ink tanks 54*a* to 54*d* and a diluent tank 54*e*. Specifically, as shown in FIG. 5, four ink tanks 54*a* to 54*d* separately storing respective Bk(black), C(cyan), M(magenta) and Y(yellow) inks, and one diluent tank 54*e* storing a diluent for diluting these inks are mounted on ink head carriage 52, side by side, in this order along the main scan direction (in the direction of the reciprocating movement of ink head carriage 52, indicated by arrows I and II in the drawing).

Ink head 53 has a multiple number of nozzles (the arrangement of the nozzles will be described later) individually connected by way of unillustrated feed channels to tanks 54*a* to 54*e*.

The present color ink-jet printer 1 has an unillustrated controller that controls associated part thereof. It should be noted that the process and operation of color ink-jet printer 1 to be described herein is controlled by this controller, unless otherwise specified.

Explanation of the Arrangement of the Nozzles

Figure 6:
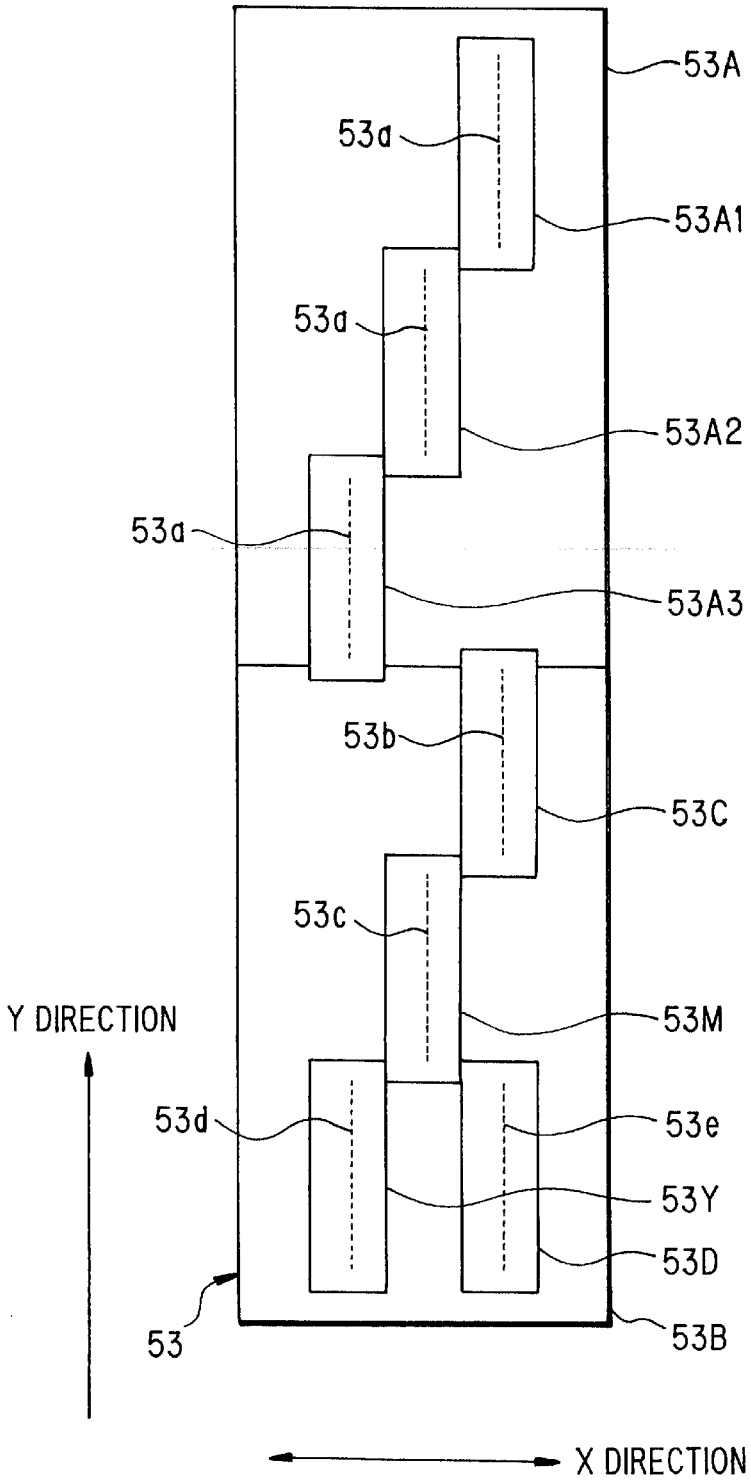
FIG. 6 is a diagram of the arrangement of nozzles viewed from the ink-jet head toward the recording paper.

Next, the arrangement of the nozzles will be described. FIG. 6 is a view showing the arrangement of nozzles 53*a* to 53*e* when ink head 53 is viewed from the top (viewed in the direction from ink head 53 toward recording paper P). In FIG. 6, ink head 53 reciprocates in the X-direction and recording paper P is conveyed in the Y-direction.

Ink head 53 is comprised of a black head block 53A and color head block 53B. Black head block 53A has three black heads 53A1, 53A2 and 53A3. Color head block 53B has a cyan head 53C, magenta head 53M and yellow head 53Y respectively corresponding to cyan(C), magenta(M) and yellow(Y), and a diluent head 53D corresponding to the diluent.

Black heads 53A1, 53A2 and 53A3 are provided with black nozzles 53*a*, 53*a*, . . . , connected to a black tank 54*a*, and cyan head 53C is provided with cyan nozzles 53*b* connected to a cyan tank 54*b*, magenta head 53M with magenta nozzles 53*c* connected to a magenta tank 54*c*, yellow head 53Y with yellow nozzles 53*d* connected to an yellow tank 54*d*, and diluent head 53D with diluent nozzles 53*e* connected to a diluent tank 54*e*. Here, diluent nozzles 53*e* may be arranged adjacent to each of other nozzles 53*a*, 53*b*, 53*c* and 53*d*.

For each ink or liquid, a large number of nozzles (53*a* to 53*e*) are arrayed in the Y-direction in the drawing on a straight line for ejecting the same color of ink. The nozzles for ejecting the diluent are also arrayed on a straight line. Each array of nozzles are made up of, for example, 64 nozzles, to provide a 600 dpi resolution.

Explanation of the Print Operation

As the printing operation of the present color ink-jet printer 1 starts, a sheet of recording paper P is picked up from a stack of sheets held in paper feed cassette 3, by the pickup roller and conveyed by feed roller 11 and paired conveying rollers 12. Then this recording paper P, while its leading edge is set in register with the image information by a PS roller, is conveyed to an image forming station 16 opposite ink head 53. Then, when the recording paper P passes image forming station 16, ink droplets of colors and diluent droplets are individually ejected from nozzles 53*a* to 53*e* of ink head 53 in accordance with the position of recording paper P and the image data so as to form an image on the upper surface of recording paper P.

To explain this image forming operation specifically, when recording paper P has been conveyed to image forming station 16, inks and diluent liquid are ejected from nozzles 53*a* to 53*e* toward recording paper P whilst ink head carriage 52 moving in the direction of arrow I (main scan direction) in FIG. 5, to thereby form an image on recording paper P. When ink head carriage 52 moves to the end of one side of recording paper P, recording paper P is moved (fed) by the predetermined distance (moved in the auxiliary scan direction indicated by the arrow III in FIG. 5) and then stopped. Then, image forming is continued whilst ink head carriage 52 is moving in the direction of the arrow (main scan direction) II in FIG. 5. In this way, the image forming operation by the reciprocating movement of ink head carriage 52 and the feed operation of recording paper P are effected alternately, thus forming an image on the entire page of recording paper P.

Recording paper P with an image formed in the overall area on the surface thereof is discharged toward output tray 4 by discharging device 15. The recording paper thus undergoing the predetermined image forming is discharged face-up(with the image forming face set upwards) onto paper output tray 4.

Explanation on Discharging Device 15

Next, discharging device 15 involving the main features of this embodiment will be described. This discharging device 15 includes a rubber roller 7 as a conveying roller in contact with the underside of recording paper P and a star roller 8 in contact with the upper surface (image forming face) of recording paper P, so that recording paper P is held by and conveyed between these two rollers 7 and 8 and is discharged toward output tray 4 thereby.

Figure 7:
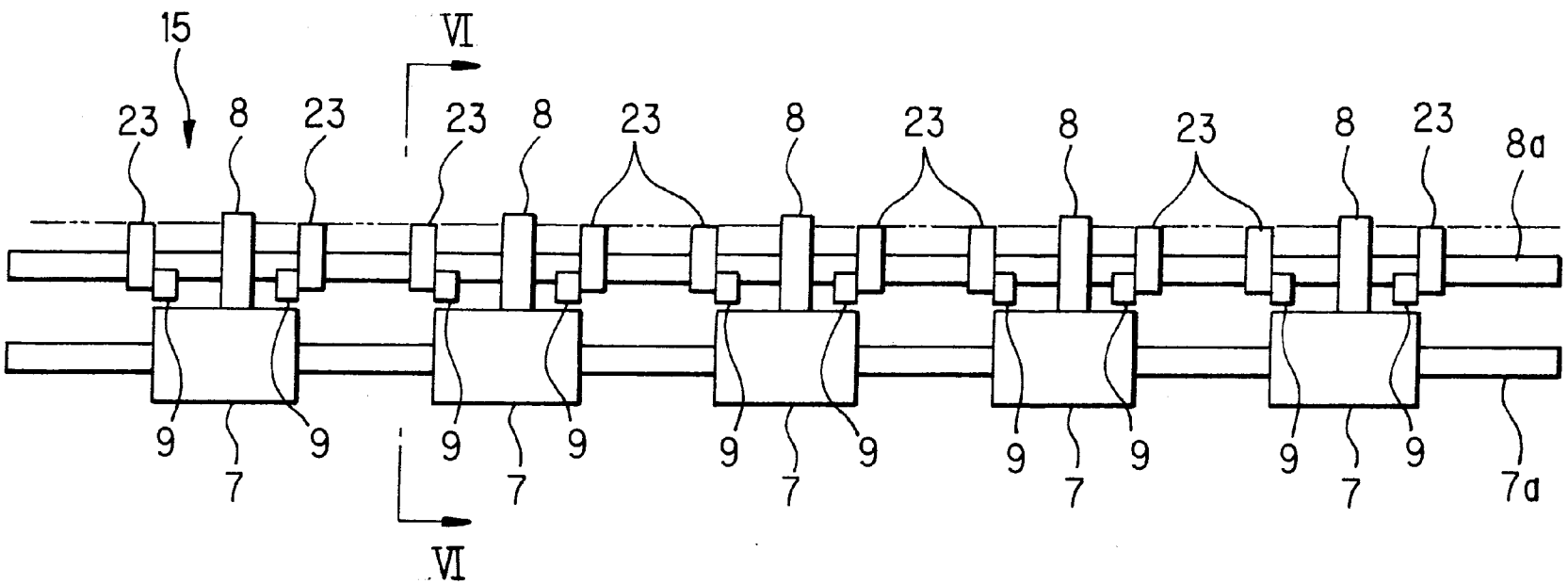
FIG. 7 is a diagram of a discharging device viewed from a point on the output tray side.
Figure 8:
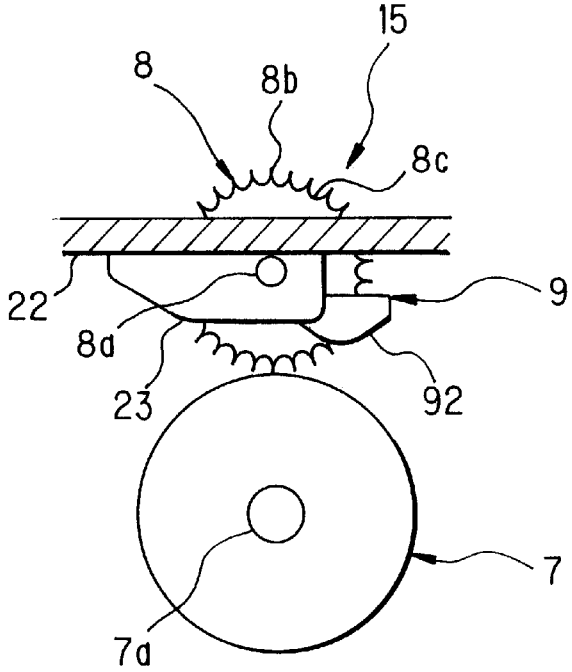
FIG. 8 is a sectional view cut along a plane VI—VI in FIG. 7.

FIG. 7 is a view showing this discharging device 15 from the paper output tray 4 side (viewed from a point on the downstream side toward the upstream side with respect to the feed direction of recording paper P). FIG. 8 is a sectional view cut along a plane VI—VI in FIG. 7. As shown in these drawings, discharging device 15 has a pair of roller shafts 7*a* and 8*a* which are rotatably arranged at the top and bottom and are extended horizontally (the left to right direction in FIG. 7) orthogonal to the feed direction of recording paper. The lower roller shaft 7*a* has rubber roller elements 7, 7, . . . , integrally attached at multiple sites (five sites in this embodiment) across its length. The upper roller shaft 8*a* has star roller elements 8, 8, . . . , integrally attached at multiple sites (five sites in this embodiment) across its length corresponding to the positions of the above rubber roller elements 7, 7, . . . .

The lower roller shaft 7*a* is adapted to be driven by an unillustrated motor. That is, rubber roller elements 7, 7, . . . function as a driving roller for rotation. In contrast, no driving force acts on the upper roller shaft 8*a*. That is, star roller elements 8, 8, . . . function as a follower roller turning along with the conveyance of recording paper P. This upper roller shaft 8*a* is urged downward by unillustrated springs, so that star roller elements 8, 8, . . . , are brought into contact with rubber roller elements 7, 7, . . . , with a predetermined pressure. As enlarged and shown in FIG. 9, this star roller element 8 is formed with discrete projections 8*b*, 8*b* . . . , radially arranged on the peripheral surface thereof with recessed portions 8*c*, 8*c* . . . , which are recesses between these projections 8*b*, 8*b*, . . . . Therefore, only the projections 8*b*, 8*b*, . . . come into contact with the upper face of recording paper P so as to reduce the contact area of the roller with the upper surface of the recording paper, whereby ink smudges on the recording paper will not occur.

The main feature of this embodiment resides in that paper guides 9, 9, . . . as guide means are provided adjacent to star roller elements 8, 8, . . . . Next, this paper guide will be explained.

Figure 9:
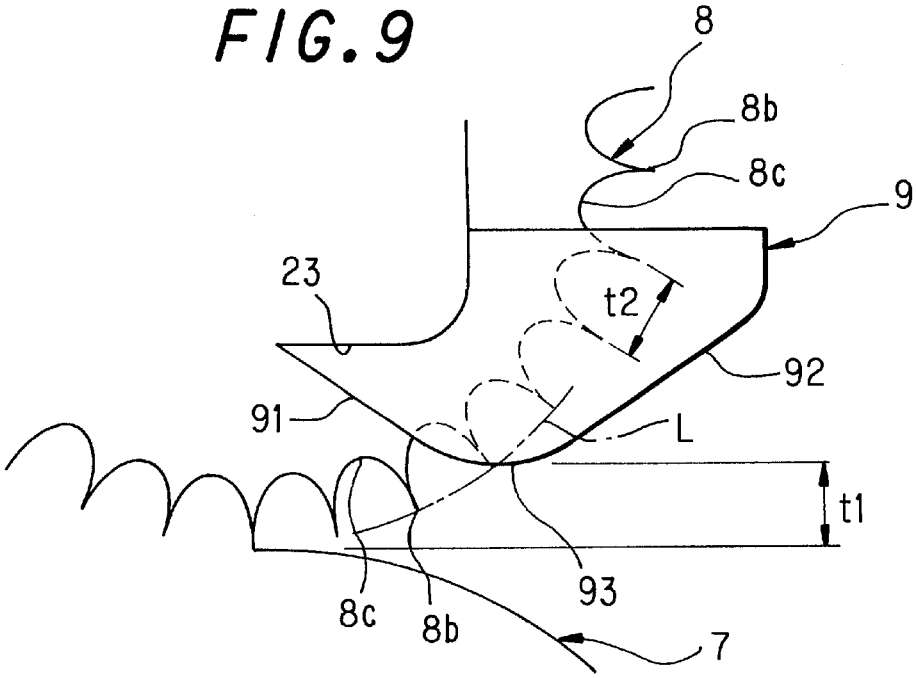
FIG. 9 is an enlarged view of a paper guide and its peripheral parts.

As shown in FIGS. 8 and 9, paper guide 9 is attached to a bearing member 23 for rotatably supporting the upper roller shaft 8*a*. This bearing member 23 is integrally formed with the upper wall, designated at 22, defining the upper opening edge of an exit port 21 (see FIG. 3) formed in cabinet 2.

As shown in FIG. 7, paper guides 9, 9, . . . , are paired so as to be arranged on both sides of each star roller element 8. That is, a pair of paper guides are disposed opposing each other, close to, and on both sides of, each star roller element 8 with respect to the direction of its rotary axis.

Further, as shown in FIG. 9, the underside of paper guide 9 is composed of a curved guide surface 91, 92, 93. This curved guide surface 91, 92, 93 is a continuous surface made up of a first slant 91, which is inclined gradually down from the lower position of bearing member 23 in the paper discharge direction, and a second slant 92, which is inclined gradually up in the paper discharge direction and a curved surface 93 smoothly connecting first slant 91 and second slant 92. In the side view shown in FIG. 9, the paper guide is arranged so that the curved surface 93 approximately overlaps the path of movement(see the dashed line L in FIG. 9) of projections 8*b* on star roller element 8. Further, the second slant 92 is positioned offset to the paper discharge side (to the right side in FIG. 9) with respect to the path of movement of projections 8*b*.

The amount of the projection of paper guide 9 downward is designated so that the level distance between the outer peripheral surface of rubber roller 7 and the bottom of paper guide 9 (the distance t1 in FIG. 9) is shorter than the interval between adjacent projections 8*b* and 8*b* of star roller element 8 (the distance t2 in FIG. 9). This amount of the projection of paper guide 9 downward may also be designated so that the level distance between the outer peripheral surface of rubber roller 7 and the bottom of paper guide 9 will be equal to the interval between adjacent projections 8*b* and 8*b* of star roller element 8.

Figure 10A:
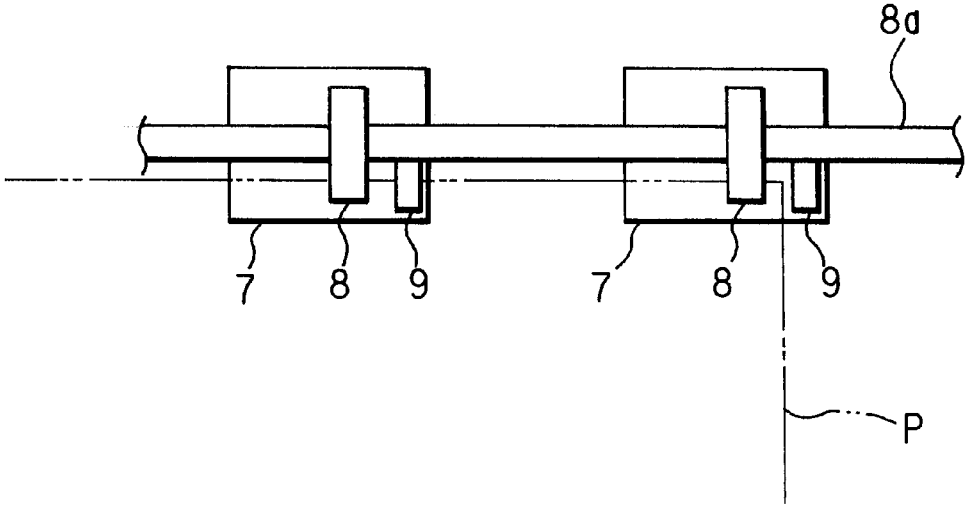
FIGS. 10A and 10B are plan views showing paper discharging devices for illustrating the contrast between the case where a paper guide is arranged on only one side of each star roller element and the case where paper guides are arranged on both sides.
Figure 10B:
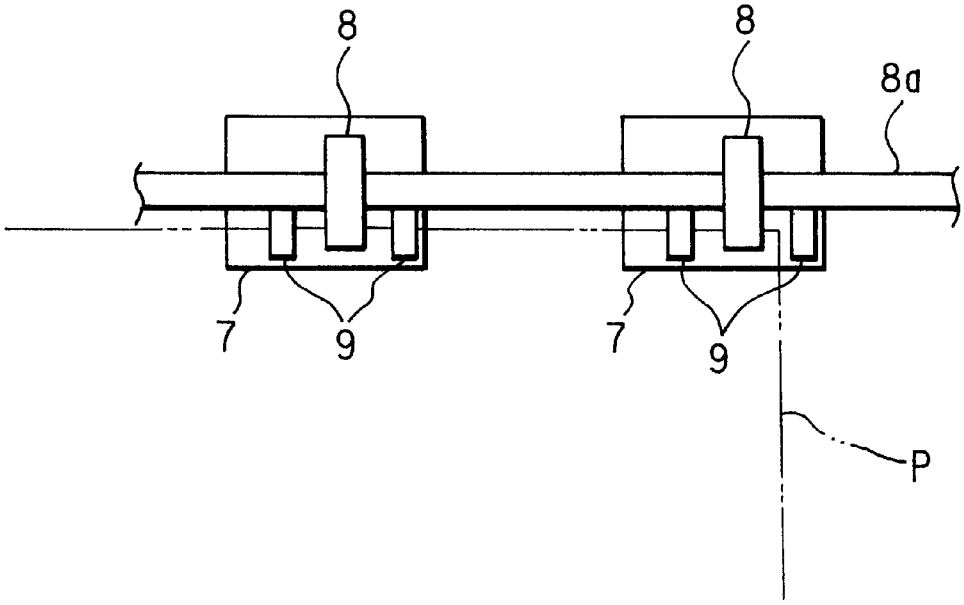

The reason why paper guides 9 and 9 are positioned opposing each other close to star roller element 8 as above will be described with reference to FIGS. 10A and 10B (plan views of paper discharging device 15). When, for example, paper guide 9 is disposed on only one side of each start roller elements 8 as shown in FIG. 10A, there is a possibility that the side edge on the upstream edge of recording paper P with respect to its feed direction (the right part in the drawing) might fail to be guided by paper guide 9 in some cases, depending upon the size or the feed position of recording paper P being conveyed (shown in an imaginary line in the figure). In contrast, as in this embodiment, when a pair of paper guides 9 and 9 are arranged adjacent to and on both sides of each star roller element 8, it is possible for the paper guide 9 to guide the part at the side edge of the upstream part of recording paper P with respect to its feed direction as shown in FIG. 10B. Thus, paired paper guides 9, 9 are arranged opposing each other and close to each star roller element 8, in order to make paper guides 9 oppose recording paper P being conveyed under such conditions.

Explanation on the Discharge Operation by Discharging Device 15

Next, the discharge operation of recording paper P by the thus configured discharging device 15 will be explained. The recording paper P with an image formed thereon by the above-described ink-jet mechanism 5 is sent to discharging device 15 and held between rubber roller 7 and star roller 8 and conveyed to paper output tray 4 as rubber roller 7 is driven to turn.

Figure 11:
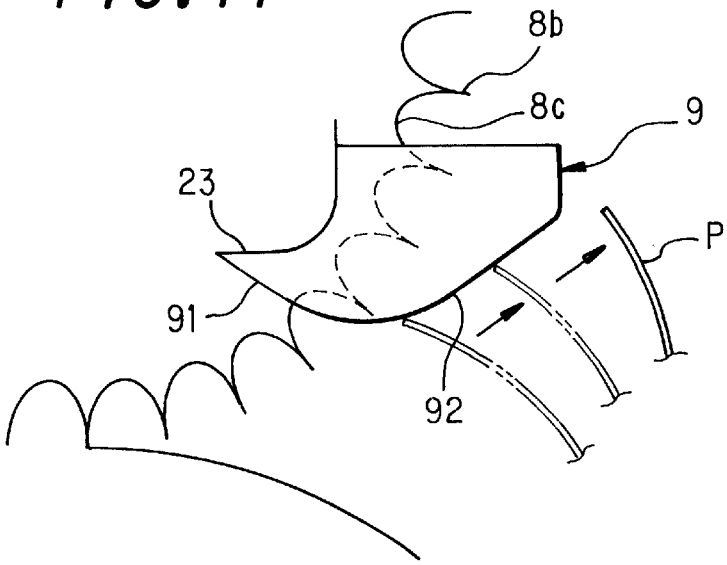
FIG. 11 is a view for illustrating the guiding action of a paper guide when recording paper is discharged.

Then, when recording paper P is released from its held state between rubber roller 7 and star roller 8 and discharged from discharging device 15, the rear edge (the upstream edge with respect to the feed direction) of recording paper P abuts, as shown in FIG. 11, the second slant 92 of paper guide 9 (see the two-dot chain line in FIG. 11). With this abutment, the rear edge of recording paper P is guided by the second slant 92 and is lead to the paper output tray 4 side (see the two-dot chain line and the solid line in FIG. 11). Since this second slant 92 is positioned offset with respect to the path of movement of projections 8*b* toward the paper discharge side, it is possible to prevent the rear edge of recording paper P from dropping into recessed portion 8*c* of star roller 8. Therefore, it is possible to avoid the rear edge of recording paper P being caught between the edge of exit port 21 and projection 8*b* of star roller 8 and hence being damaged thereby.

Since paper output tray 4 is located below exit port 21, recording paper P is discharged in a state such that the front end part (the portion on the downstream side with respect to the feed direction) of recording paper P is put in contact with paper output tray 4 while the rear part jumps upwards. Since the second slant 92 is inclined upwards in the paper discharge direction, the rear end of recording paper P is permitted to jump upwards, thus the discharge of the paper to paper output tray 4 can be smoothly performed.

Effect of the Embodiment

As has been described, in the present embodiment, since paper guides 9 are provided in order to prevent the rear edge of recording paper P from dropping into recessed portions 8*c* of star roller elements 8 when recording paper P is discharged from discharging device 15, it is possible to avoid damage to the rear edge of recording paper P, hence provide beneficial printouts. Therefore, it is possible to improve the reliability of the discharge performance of the ink-jet printer.

Variational Example

Figure 12:
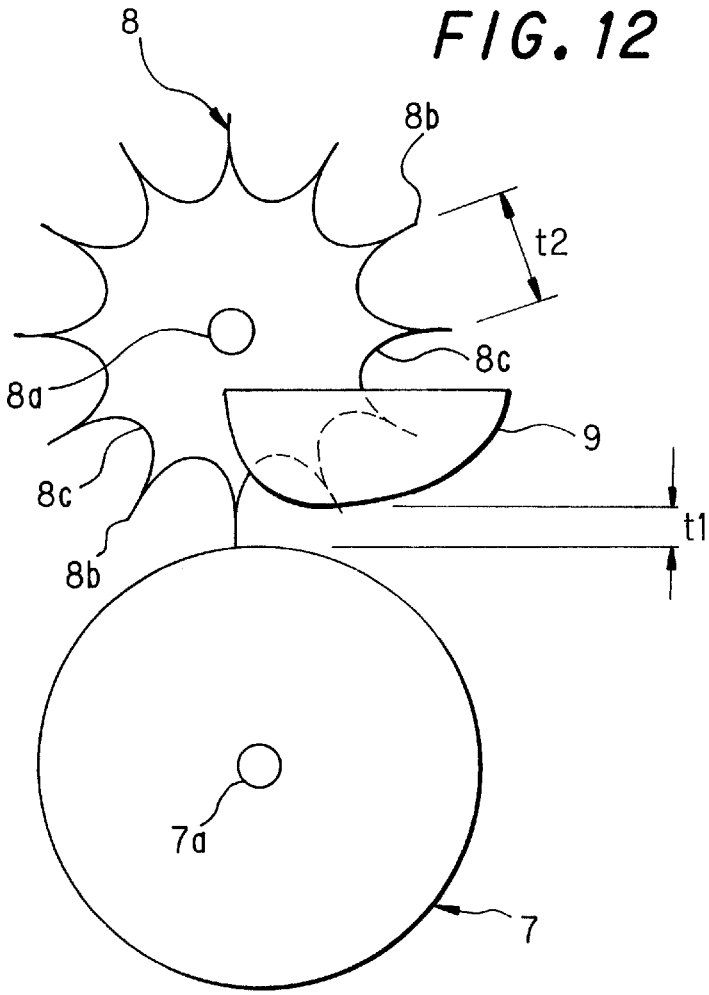
FIG. 12 is a view showing a variational example, corresponding to FIG. 8.

Next, a variational example of the present invention will be described. In this example, projections 8*b* and recessed portions 8*c* are reduced in number compared to those in the star roller 8 of the above-described embodiment. As shown in FIG. 12, star roller 8 of this example, has twelve projections 8*b*, 8*b*, . . . and recessed portions 8*c*, 8*c*, . . . on its peripheral side. Also in this case with such star roller elements 8, the level distance between the outer peripheral surface of rubber roller 7 and the bottom of paper guide 9 (the distance t1 in FIG. 11) is designated, similarly to the above embodiment, to be shorter than the interval between adjacent projections 8*b* and 8*b* of star roller 8 (the distance t2 in FIG. 11). Also in this case, the level distance between the outer peripheral surface of rubber roller 7 and the bottom of paper guide 9 may be set equal to the interval between adjacent projections 8*b* and 8*b* of star roller 8.

Other Embodiments

The above embodiment and variational embodiment were described as to configurations in which the present invention is applied to the paper discharging portion of a color ink-jet printer. The recording media discharging device of the present invention should not be limited to these but can be applied to the discharging portion of image forming apparatus such as other printers, copiers and the like.

The shape of paper guide 9 should not be limited to those shown in the embodiment and variational example described above. Any shape and configuration will be acceptable as long as it can prevent the rear edge of recording paper P from dropping into recessed portion 8*c* of star roller 8.

As has been described, the present invention has a guide means for guiding the upstream edge of a recording medium with respect to the feed direction so that the edge will not drop into the recessed portions of the star roller when the edge passes the star roller. Therefore, it is possible to avoid such a situation that the edge part of the recording medium is damaged by the projections on the peripheral side of the star roller.

Further, when as the guide means a pair of guide elements are arranged close to each star roller element and on both sides thereof with respect to the direction of the rotary shaft being extended, it is possible to positively prevent the upstream edge, with respect to the feed direction, of the recording medium, from dropping into the recessed portions of the star roller, without regard to the size and feed position of a recording medium being conveyed. Therefore, it is possible to reliably prevent damage to the recording medium.

When the guide surface of the guide means is provided with a slant for permitting the edge of recording media to jump upward, this configuration makes it possible to smoothen the discharge operation of recording media when the output portion of recording media is located below the exit position, and hence improve the discharging performance of the recording media discharging device.

In addition, by designating the level distance between the outer peripheral surface of the conveying roller which holds and conveys recording media with the star roller and the bottom of the guide means to be equal to or shorter than the interval between adjacent projections formed on the peripheral surface of the star roller, it is possible to specifically limit the shape of the guide means for preventing the edge of recording media from dropping into the recessed portions of the star roller, thus making it possible to improve the practicability of the recording media discharging device.

When the above recording media discharging device is provided for an ink-jet printer, it is possible to provide a reliable ink-jet printer which can provide beneficial printouts without the recording media damaged.

What is claimed is:

1. A recording media discharging device using a star roller for conveying recording media with images formed thereon In the discharge direction, comprising:

guide means for guiding the upstream edge of a recording medium with respect to the feed direction so that the edge will not drop into the recessed portions on the peripheral side of the star roller when the edge passes the star roller, wherein a lower edge of the guide means on a downstream side of a rotational axis of the star roller, relative to the feed direction, extends lower than a lower edge of the guide means on an upstream side of the rotational axis, wherein the guide means has a guide surface for guiding the upstream edge of a recording medium with respect to the feed direction, and this guide surface is provided with a slant which is inclined gradually up in the paper discharge direction, thereby preventing the edge of the recording medium from dropping into the recessed portions of the star roller while permitting the edge of the recording medium to jump upwards.

2. The recording media discharging device according to claim 1, wherein the star roller is comprised of multiple star roller elements arranged at separate positions on a rotatory shaft that is extended perpendicularly to the feed direction of recording media, and as the guide means a pair of guide elements are arranged close to each star roller element and on both sides thereof with respect to the extended direction of the rotary shaft.

3. The recording media discharging device according to claim 2, wherein the guide means has a guide surface for guiding the upstream edge of a recording medium with respect to the feed direction, and this guide surface is provided with a slant which is inclined gradually up in the paper discharge direction, thereby preventing the edge of the recording medium from dropping into the recessed portions of the star roller while permitting the edge of the recording medium to jump upwards.

4. The recording media discharging device according to claim 3, further comprising: a conveying roller for holding and conveying recording media between itself and the star roller, wherein a distance between the level of the outer peripheral surface of the conveying roller and the level of the bottom of the guide means is set to be equal to or shorter than an interval between adjacent projections formed on the peripheral surface of the star roller element.

5. The recording media discharging device according to claim 2, further comprising: a conveying roller for holding and conveying recording media between itself and the star roller, wherein a distance between the level of the outer peripheral surface of the conveying roller and the level of the bottom of the guide means is set to be equal to or shorter than an interval between adjacent projections formed on the peripheral surface of the star roller element.

6. The recording media discharging device according to claim 1, further comprising: a conveying roller for holding and conveying recording media between itself and the star roller, wherein a distance between the level of the outer peripheral surface of the conveying roller and the level of the bottom of the guide means is set to be equal to or shorter than an interval between the adjacent projections formed on the peripheral surface of the star roller element.

7. The recording media discharging device according to claim 1, further comprising: a conveying roller for holding and conveying recording media between itself and the star roller, wherein a distance between the level of the outer peripheral surface of the conveying roller and the level of the bottom of the guide means is set to be equal to or shorter than an Interval between adjacent projections formed on the peripheral surface of the star roller element.

8. An ink-jet printer comprising:

a recording media discharging device including: a star roller for conveying recording media with images formed thereon in the discharge direction; and guide means for guiding the upstream edge of a recording medium with respect to the feed direction so that the edge will not drop into the recessed portions on the peripheral side of the star roller when the edge passes the star roller, wherein a lower edge of the guide means on a downstream side of a rotational axis of the star roller, relative to the feed direction, extends lower than a lower edge of the guide means on an upstream side of the rotational axis, and an image Is formed on the upper surface of the recording medium by ejecting ink droplets from an image forming means, and the recording medium with an image formed thereon is discharged toward an output portion by the recording media discharging device, wherein the guide means has a guide surface for guiding the upstream edge of a recording medium with respect to the feed direction, and this guide surface is provided with a slant which is inclined gradually up in the paper discharge direction, thereby preventing the edge of the recording medium from dropping into the recessed portions of the star roller while permitting the edge of the recording medium to jump upwards.

9. The ink-jet printer according to claim 8, wherein the star roller is comprised of multiple star roller elements arranged at separate positions on a rotary shaft that is extended perpendicularly to the feed direction of recording media, and as the guide means a pair of guide elements are arranged close to each star roller element and on both sides thereof with respect to the extended direction on the rotary shaft.

10. The ink-jet printer according to claim 9, wherein the guide means has a guide surface for guiding the upstream edge of a recording medium with respect to the feed direction, and this guide surface is provided with a slant which is inclined gradually up in the paper discharge direction, thereby preventing the edge of the recording medium from dropping into the recessed portions of the star roller while permitting the edge of the recording medium to jump upwards.

11. The ink-jet printer according to claim 10, wherein the recording media discharging device further includes: a conveying roller for holding and conveying recordin9 media between itself and the star roller and a distance between the level of the outer peripheral surface of the conveying roller and the level of the bottom of the guide means is set to be equal to or shorter than an interval between adjacent projections formed on the peripheral surface of the star roller element.

12. The ink-jet printer according to claim 9, wherein the recording media discharging device further includes: a conveying roller for holding and conveying recording media between itself and the star roller and a distance between the level of the outer peripheral surface of the conveying roller and the level of the bottom of the guide means is set to be equal to or shorter than an interval between adjacent projections formed on the peripheral surface of the star roller element.

13. The ink-jet printer according to claim 8, wherein the recording media discharging device further includes: a conveying roller for holding and conveying recording media between itself and the star roller and a distance between the level of the outer peripheral surface of the conveying roller and the level of the bottom of the guide means is set to be equal to or shorter than an interval between adjacent projections formed on the peripheral surface of the star roller element.

14. The ink-jet printer according to claim 8, wherein the recording media discharging device further includes: a conveying roller for holding and conveying recording media between itself and the star roller and a distance between the level of the outer peripheral surface of the conveying roller and the level of the bottom of the guide means is set to be equal to or shorter than an interval between adjacent projections formed on the peripheral surface of the star roller element.

* * * * *